US005336007A

United States Patent [19]

Jozat

[11] Patent Number: 5,336,007

[45] Date of Patent: Aug. 9, 1994

[54] PLOTTER PEN WITH INDICATOR CIRCUIT

[75] Inventor: Walter Jozat, Bad Bramstedt, Fed. Rep. of Germany

[73] Assignee: Koh-I-Noor Inc., Bloomsbury, N.J.

[21] Appl. No.: 73,620

[22] Filed: Jun. 8, 1993

Related U.S. Application Data

[63] Continuation of Ser. No. 687,752, Apr. 19, 1991, abandoned.

[30] Foreign Application Priority Data

Apr. 24, 1990 [DE] Fed. Rep. of Germany ..... 4013011

[51] Int. Cl.[5] ..... B43K 8/18; B43K 5/18; B43K 7/03; B43K 7/10

[52] U.S. Cl. ..... 401/151; 401/190; 401/194; 401/195; 401/258

[58] Field of Search ..... 401/151, 194, 195, 190, 401/258; 346/140 A

[56] References Cited

U.S. PATENT DOCUMENTS

| | | | |
|---|---|---|---|
| 4,350,458 | 9/1982 | Murahara et al. | 401/194 X |
| 4,573,819 | 3/1986 | Herrnring | 401/194 X |
| 4,605,331 | 8/1986 | Held | 401/190 X |
| 4,634,305 | 1/1987 | Herrnring | 401/151 |
| 4,708,506 | 11/1987 | Herrnring | 401/151 |

FOREIGN PATENT DOCUMENTS

| | | | |
|---|---|---|---|
| 0015784 | 9/1980 | European Pat. Off. . | |
| 0961177 | 12/1983 | European Pat. Off. . | |
| 2129714 | 12/1971 | Fed. Rep. of Germany | 401/258 |
| 3321301 | 12/1984 | Fed. Rep. of Germany . | |
| 2206193 | 6/1974 | France . | |

*Primary Examiner*—Steven A. Bratlie

*Attorney, Agent, or Firm*—Fitzpatrick, Cella, Harper & Scinto

[57] ABSTRACT

A technical pen, in particular for use in a drafting instrument such as a plotter, with a writing tube (4) fixed in the front end of a pen tip (1, 2, 3), into which a cleaning wire (5), fastened to the front end of a drop weight body (6), extends, has a device (20, 23, 24) for monitoring the writing fluid level in a buffer chamber (15) disposed between the front end of the inner bore (7) and the back end of the writing tube (4) as well as for activating a conveying means (25) for transporting writing fluid from the inner bore (7) into the buffer chamber (15) when the writing fluid has fallen below a pre-determined level. The buffer chamber (15) is formed centrally symmetrical in relation to the center axis of the writing tube (4) and its inner and outer boundary walls (16, 17) converge from the front to the back. The front area of the buffer chamber (15) is connected with the writing tube (4) and the inner bore (7), while its rear area is closed. At least the backwards converging sections of the boundary surfaces of the buffer chamber (15) are made of an electrically conducting material and are each connected with a contact (23, 24) of an electric control circuit. The contacts (23, 24) can be electrically connected by means of the electrically conducting writing fluid, and, when the electrical connection between the contacts (24, 25) is interrupted, the control circuit activates the conveying means (25).

6 Claims, 3 Drawing Sheets

PLOTTER PEN WITH INDICATOR CIRCUIT

This application is a continuation of application Ser. No. 07/687,752 filed Apr. 19, 1991, now abandoned

BACKGROUND OF INVENTION

1. Field of Invention

The invention generally relates to a technical pen, and, in particular, one for use in a drafting instrument such as a plotter, comprising a writing tube fixed in the front end of a pen tip, into which a cleaning wire, fastened to the front end of a drop weight body, extends from the rear. The drop weight body is disposed so that it is axially movable back and forth in a limited way in an inner bore which is connected with a writing fluid reservoir, An indicator device for monitoring the writing fluid level is disposed in a buffer chamber between the front end of the inner bore and the back end of the writing tube. The indicator device activates a conveying means for transporting writing fluid from the inner bore into the buffer chamber when the writing fluid has fallen below a pre-determined level.

2. Brief description of the prior art

One writing instrument, in the form of a fountain pen, having a pump conveying means to transport writing fluid into a buffer chamber near the nib and a capacitive sensor device to monitor writing fluid level in that buffer chamber is described in German published Patent Application, DE-OS 33 21 301 which is equivalent to HERRNRING (U.S. Pat. Nos. 4,634,305 and 4,708,506). The capacitive sensor of this writing instrument is not shown in any detail, but apparently forms the front boundary wall of the buffer chamber, through which a bore extends as a connection with the nib. If such a writing instrument is held exactly vertical, the sensor will be completely wetted if writing fluid is present in the buffer chamber. However, the sensor will only partially be wetted if the writing instrument is held at an angle. Hence, there is a possibility that the sensor falsely will signal a lack of writing fluid in the buffer chamber when the writing instrument is held at an angle, whereby the conveying means will move writing fluid into the buffer chamber, even though not necessary.

OBJECT AND SUMMARY OF THE INVENTION

It is the object of the invention to produce a technical pen where exact monitoring of the writing fluid level in a buffer chamber is provided, so that a slight tilting of the pen will not cause a change in the indication of fluid level. To attain this object, a technical pen of the above-described type is designed in accordance with the invention in such a way that the buffer chamber is formed centrally symmetrical in relation to the center axis of the writing tube. Further, the inner and outer boundary walls converge from the front to the back, so that the front area of the buffer chamber is connected with the writing tube and the inner bore. At least the backward converging sections of the boundary surfaces of the buffer chamber are made of an electrically conducting material, are each surface is connected with a contact of an electric control circuit, and can electrically be connected through the medium of the electrically conducting writing fluid. The conveying means is activated when the electrical connection between the contacts of the control circuit is interrupted.

A technical pen in accordance with the invention, is particularly suitable for use in plotters because it can be tilted to a certain extent along with the plotter, since the buffer chamber is centrally symmetrical. The buffer chamber walls are electrically conducting, so that electrically conducting writing fluid in the buffer chamber electrically connects the inner and outer boundary walls of the buffer chamber when the fluid level is sufficiently high. In this way a connection between the contacts of the control circuit indicates that the fluid level is sufficient. Only when this contact is interrupted does the activated conveying means transport writing fluid into the buffer chamber in order to restore an electrical connection between the inner and the outer boundary walls of the buffer chamber. Because of the shape of the buffer chamber of this design, the electrical connection between the contacts of the control circuit is not interrupted if the technical pen is tilted in any arbitrary direction. While displacement of the writing fluid in the buffer chamber may take place, the electrical connection is maintained.

Practically all commercially available inks have sufficient electrical conductivity for use in the invention. A particularly suitable ink contains 20% by weight of a carbon black dispersion, 20 to 25% by weight of a shellac solution, 5% by weight of glycol, such as ethylene glycol or diethylene glycol, 0.3 to 0.5% by weight of a preservative such as phenol, and sufficient deionized water to reach 100%.

The boundary walls of the buffer chamber can extend as straight lines in planes containing the central axis of the technical pen. For example, the buffer chamber may have the shape of a backward converging cone, or a truncated cone or a pyramid or a truncated pyramid.

The boundary walls of the buffer chamber also may extend as curves in planes containing the central axis of the technical pen. If a constant radius of curvature is provided, a buffer chamber in the shape of a spherical annulus between two concentric spheres is formed. If the radius of curvature increases from front to back, the buffer chamber may have the shape of a partial ellipsoid annulus or a paraboloid annulus.

One particularly simple structure comprises a conveying means having a piston, that is in sealing contact with the interior wall of the writing fluid reservoir and is displaced in the direction towards the back end of the inner bore. Displacing the piston towards the back end of the inner bore, can push writing fluid from the inner bore into the buffer chamber in a very simple manner, without the necessity of a comparatively complicated pump.

The forward push of the piston can be caused by generating an overpressure with the help of a gas. For this purpose, the back end of the writing fluid reservoir can be closed off gas-tight, while the gas is introduced in a controlled manner into the area between a back surface of the writing fluid reservoir and the back surface of a free piston. A known gas-generating cell can be employed for producing the gas, such as the one manufactured by Simatec Gas-Cell-Technic, CH-3360 Herzogenbuchsee, Switzerland. Such a gas-generating cell gives off gas, for example, hydrogen, when its contacts are electrically short-circuited. The rate of gas generation is directly proportional to the flowing electrical current. Gas production is stopped immediately when the electrical circuit is interrupted. For this reason the forward push of the piston and, therefore, the supply of writing fluid into the buffer chamber can be very closely controlled.

The invention will be described in detail below by means of the drawings illustrating exemplary embodiments.

DETAILED DESCRIPTION OF THE PREFERRED EMBODIMENTS

Figure 1:
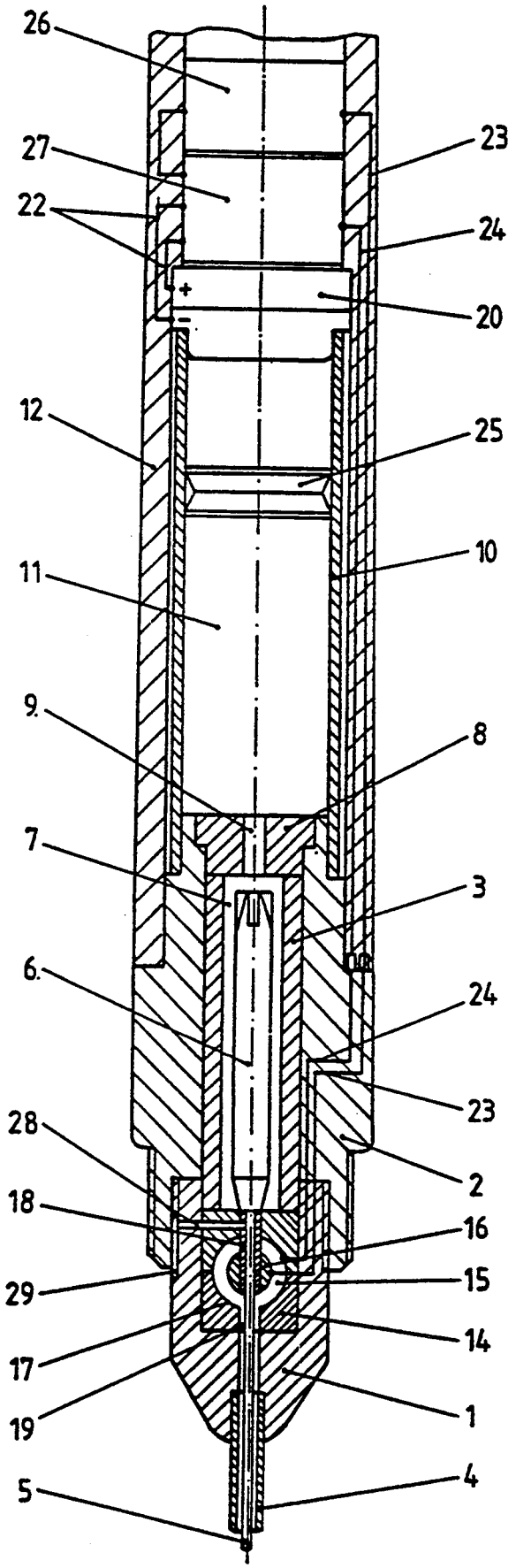
FIG. 1 is a sectional view of the technical pen of the present invention.

The technical pen illustrated in FIG. 1 has a pen tip consisting of elements 1, 2 and 3. A writing tube 4 has been inserted into the front end of element 1. Into element 2, which is screwed to element 1, a bushing element 3 has been inserted, which is closed at the back end by a drop weight safety 8 having a through-bore 9 and which forms an inner bore 7. Inside the inner bore 7 there is a drop weight body 6, which can be moved back and forth axially, in a limited way. On its front end a cleaning wire 5 is fastened, which extends through an insert 14, still to be described, and in a conventional way into the writing tube 4. In the illustrated front position of the drop weight body 6, the wire 5 slightly extends beyond the front end of the writing tube 4. A tube-shaped writing fluid reservoir 10 has been sealingly engaged to the back end of the element 2 of the pen tip and is surrounded by a holder element 12, screwed to the back end of the element 2. An axial forwardly displaceable piston 25 is sealingly seated in the interior chamber 11 of the writing fluid reservoir 10 and is in direct contact with the writing fluid in the interior chamber 11. Therefore, for all practical purposes there is only writing fluid and no air in the interior chamber 11 of the writing fluid reservoir 10 located in front of the piston 25.

A cylindrical battery 26 extends towards the back from the back end of a cylindrical relay 27 which are inserted with a gas-generating cell 20 sealing that also is inserted into the holder 12, so that a gas-tight chamber is formed in the holder 12 between the gas-generating cell 20 and the free piston 25. A control circuit (FIG. 3) located in the holder 12 to act on the gas-generating cell 20. The gas generated from the cell enters a chamber formed between the cell 20 and the piston 25.

The above-mentioned insert 14 has been inserted from the back into the element 1 of the pen tip and is maintained in its position with the help of the bushing element 3 of the pen tip, so that the insert 14 forms the front end of the inner bore 7. The insert is divided in a horizontal plane (of the drawing figure) into two sections. The front section is connected with the writing tube 4 via a bore 19. The cleaning wire 5 also extends through the bore 19. A tube 18 is located in the rear section, providing the connection to the inner bore 7, and the cleaning wire 5 extends through the tube 18. A ball element is fixed on the front end of the tube 18 and forms the interior boundary wall of a buffer chamber 15, which is in the form of a spherical shell between two concentric spheres, and bounded on the exterior by a wall 17 of the two sections of the insert 14. The tube 18 extends with its front end through the ball element which forms the interior boundary wall 16 of the buffer chamber. Therefore, the inner bore 7 is connected only with the buffer chamber 15 on the front side, located opposite the bore 19, of the ball element forming the interior boundary wall 16, while the back area of the buffer chamber 15 is closed. The interior of the tube 18, and thus the buffer chamber 15, is connected to the ambient air by means of the connecting bore 28, which has a very small cross section, and a depression or aperture 29 in outer surface of the element 1. During the supply of writing fluid (yet to be described), pressure jolts may occur and can be bled off to the exterior.

The surfaces formed by the boundary walls 16 and 17 of the buffer chamber 15 are made of electrically conducting material, for example, of copper applied by vaporization. The contacts 23 and 24 are connected with the electrically conductive surfaces and are extended through the elements 1 and 2 of the pen tip and the wall of the holder 12 to the control circuit located in the gas generating cell 20. The route of the connections is shown only schematically.

During use, writing fluid reaches the inner bore 7 of the pen tip from the interior chamber 11 of the writing fluid reservoir 10 through the through-bore 9 of the drop weight safety 8 and front there through the tube 18 to the buffer chamber 15 and through the bore 19 to the writing tube 4. In the technical pen illustrated, no pressure equalization chamber is required because of the absence of large amounts of air in the writing fluid system. For all practical purposes there is only a small amount of air to the rear area that is above the buffer chamber 15. This amount of air is very small, so that in the course of temperature changes it does not have any effect that is significant on the total pressure in the writing fluid system.

Initially it is assumed that the buffer chamber 15 has been filled with sufficient writing fluid so that the writing fluid is in contact with the interior boundary wall 16 of the buffer chamber 15. In this position the electrically conducting writing fluid makes an electrical connection between the contacts 23 and 24, i.e. the contact indicated in FIG. 3 by 15′ (in the buffer chamber) is closed (as shown by dashed lines). This state does not change even if the technical pen is tilted out of the vertical position shown in the drawing figure, because the electrically conducting connection by means of the writing fluid between the contacts 23 and 24 is still maintained. However, it should be noted that preferably the tilting is only approximately 30°. Otherwise, even with the electrical connection between the contacts 23 and 24, the writing fluid in the buffer chamber 15 may be no longer connected with the bore 19, and, therefore, no longer connected with the writing tube 4. However, inclinations of more than 30° are not customary in connection with use of technical pens used for plotters.

In the closed state of the contact 15′, the battery 26 energizes the coil of the relay 27 and keeps its contact open (as shown by dashed lines in FIG. 3), so that the circuit of the gas generation cell 20 containing the lines 22, which has its own current supply, is interrupted.

Figure 3:
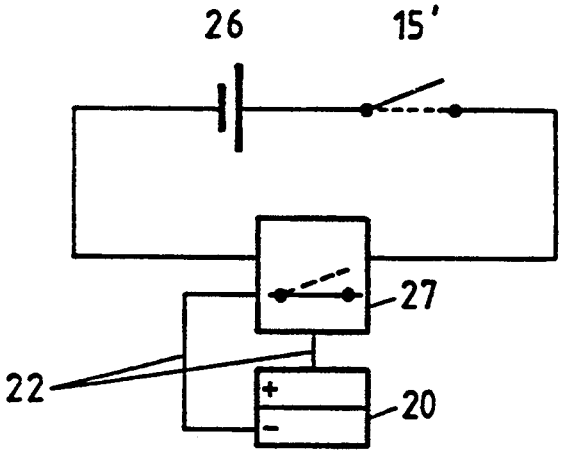
FIG. 3 schematically shows a block diagram for operating the technical pen in accordance with FIG. 1.

When the writing fluid in the reservoir 10 is used up and the writing fluid level in the buffer chamber 15 is thereby lowered far enough so that the electrical connection between the contacts 23 and 24 is interrupted, the contact 15′ in accordance with FIG. 3 is opened, tile contact closes in the relay 27 and the circuit for the gas generation cell 20 is closed. Accordingly, the gas generation cell discharges gas into the sealed interior chamber of the holder 12 located ahead of it. This discharge of gas charges the back end of the piston 25 with pressure and the piston 25 moves forward accordingly. The forward movement of the piston pushes writing fluid forward out of the interior chamber 11 of the writing fluid reservoir 10 and through the tube 18 into the buffer chamber 15 until a fluid level has again been achieved therein so that an electrical connection between the contacts 23 and 24 is made. This electrical connection leads to the interruption of gas generation and thus to an end of the forward push of the piston 25.

Figure 2:
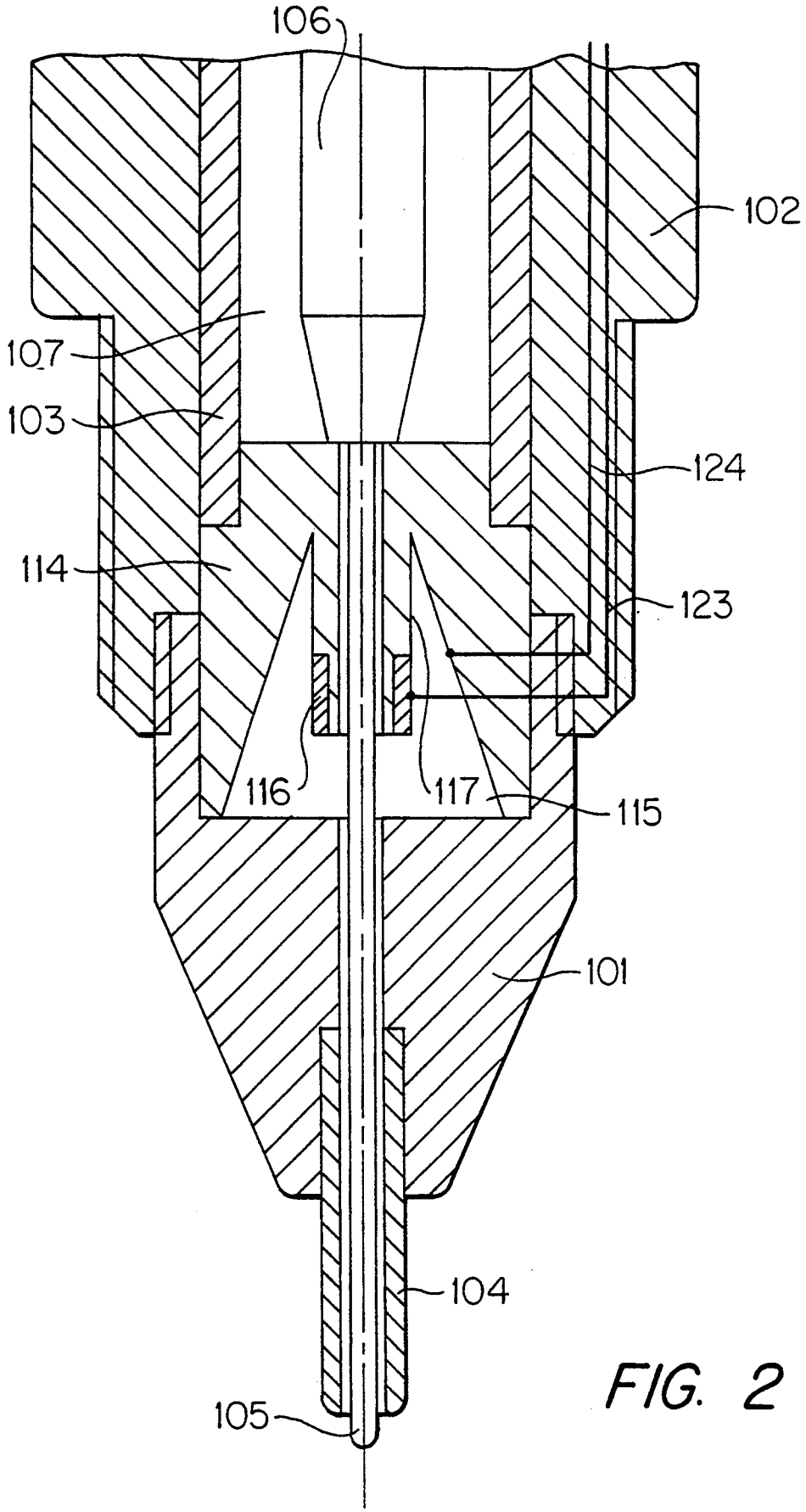
FIG. 2 is a sectional view of the front part of another embodiment of the technical pen of the present invention.

FIG. 2 shows the front end section of another embodiment of the technical pen, according to the present invention. The embodiment is similar to a large degree with the design of the technical pen in accordance with FIG. 1. The same or corresponding parts have been designated with the same reference numerals, increased by a value of 100.

The difference between the exemplary embodiment in accordance with FIG. 1 and the exemplary embodiment in accordance with FIG. 2 lies essentially in the shape of the buffer chamber. In accordance with FIG. 1, the buffer chamber is essentially in the shape of a spherical shell. In the exemplary embodiment in accordance with FIG. 2, a peripheral wall which is essentially in the shape of a truncated cone is formed in the insert 114 and bounds the buffer chamber 115 around its peripheral direction. The truncated cone-shaped wall is coated with an electrically conducting material, and the electrical contact line 124 is connected to the conducting coating.

The insert 114 forms a cylindrical section 117 concentrically with its central bore, which is penetrated by the cleaning wire 105. The cylindrical section 117 extends from the rear wall to the front of the peripheral wall of the buffer chamber 115, and ends at a distance from the front end of the buffer chamber 115. In this way the buffer chamber 115 is connected with the through-bore for the cleaning wire 105 provided in the element 101. A conducting coating 116, which is connected with the electrical contact line 123, is formed on the exterior surface of the front end of the cylindrical section. The area of the cylindrical section located behind the conducting coating 116 remains uncoated and in this way forms an electrically insulating surface. Therefore, during use, an electrical connection between the electrically conducting material-coated surface of the peripheral wall of the buffer chamber 115 and the coating 116 can only be achieved via an electrical connection through writing fluid present in the buffer chamber 115.

The buffer chamber 115 is only connected with the ambient air by means of the writing tube 104 and with the inner bore 107 towards the back. The back part of the buffer chamber 115, which is bounded on the inside by the peripheral wall of the cylindrical section, is closed towards the back.

If, during use, the buffer chamber 115 is filled with writing fluid to such an extent that it makes an electrical connection between the conducting coating 116 and the conducting coating of the peripheral wall of the buffer chamber 115, (i.e. between electrical contact lines 123 and 124), the gas generating cell (not shown) does not emit any gas. This previously was explained in connection with the exemplary embodiment of FIG. 1. Only when the electrical connection between the lines 123 and 124 has been interrupted, which occurs with the appropriate lowering of the writing fluid level in the buffer chamber 115, is the gas generation cell activated, causing the transporting of writing fluid into the buffer chamber 115 until the electrical connection is again made.

While the present invention has been described with respect to what presently are considered to be embodiments, it is to be understood that the invention is not limited to the disclosed embodiments. To the contrary, the present invention is intended to cover various modifications and equivalent arrangements included with the spirit and scope of the appended claims. The following claims are to be accorded a broad interpretation, so as to encompass all such modifications and equivalent structures and functions.

I claim:

1. In a technical pen comprising a writing tube (4) fixed in the front end of a pen tip (1, 2, 3), a cleaning wire (5), fastened to the front end of a drop weight body (6), and extending into said writing tube from the rear, said drop weight body (6) being disposed so that it is axially movable back and forth in a limited way in an inner bore (7) that is connected with a writing fluid reservoir (10) for holding an electrically conductive writing fluid, the improvement which comprises a device (20, 23, 24) for monitoring the writing fluid level in a buffer chamber (15) disposed between the front end of the said inner bore (7) and the back end of the writing tube (4), said device further comprising means to activate a conveying means that is adapted to transport writing fluid from said inner bore (7) into said buffer chamber (15) when the writing fluid has fallen below a pre-determined amount, wherein said buffer chamber (15) is formed by boundary wall surfaces arranged in a central symmetrical relation to the center axis of the writing tube (4) so as to define inner and outer boundary walls (16, 17), wherein said inner and outer boundary walls (16, 17) of the buffer chamber (15) extend as curves in planes containing the central axis of the writing tube (4), and wherein a front area of said buffer chamber (15) is connected with said writing tube (4) and said inner bore (7) and at least the rearmost sections of the boundary wall surfaces of the buffer chamber (15) are made of an electrically conducting material and are each connected with a contact (23, 24) of an electric control circuit, wherein said contacts will be electrically connected through said electrically conducting writing fluid; whereby said conveying means will be activated when an electrical connection between the contacts (23, 24) of said control circuit is interrupted.

2. A technical pen in accordance with claim 1, wherein the radius of curvature for each of the boundary walls (16, 17) is constant in said planes.

3. A technical pen in accordance with claim 1, wherein the radius of curvature for each of the boundary wall increases from the front to the back in said planes.

4. A technical pen in accordance with claim 1, wherein said conveying means comprises a free piston (25), which is in sealing contact with the interior wall of said writing fluid reservoir (10) and which can be displaced in a forward direction so as to urge writing fluid towards the back end of said inner bore (7).

5. A technical pen in accordance with claim 4 wherein said back end of said writing fluid reservoir (10) is sealed gas-tight, and said conveying means further comprises a gas that is introduced in a controlled manner into an area between the reservoir back end and the backside of the free piston (25) for creating an overpressure, and displacing said writing fluid.

6. A technical pen in accordance with claim 5 wherein a gas generation cell (20) is provided for generating said gas.

* * * * *